US008177534B2

(12) United States Patent
Ni

(10) Patent No.: US 8,177,534 B2
(45) Date of Patent: May 15, 2012

(54) SCROLL-TYPE FLUID DISPLACEMENT APPARATUS WITH IMPROVED COOLING SYSTEM

(75) Inventor: Shimao Ni, Bolingbrook, IL (US)

(73) Assignee: Advanced Scroll Technologies (HangZhou), Inc., HangZhou, Zhejian Province (CN)

( * ) Notice: Subject to any disclaimer, the term of this patent is extended or adjusted under 35 U.S.C. 154(b) by 758 days.

(21) Appl. No.: 12/261,689

(22) Filed: Oct. 30, 2008

(65) Prior Publication Data

US 2010/0111740 A1 May 6, 2010

(51) Int. Cl.

| | |
|---|---|
| ***F01C 21/06*** | (2006.01) |
| ***F01C 1/02*** | (2006.01) |
| ***F01C 1/063*** | (2006.01) |
| ***F04C 29/04*** | (2006.01) |

(52) U.S. Cl. ..... 418/101; 418/83; 418/91; 418/92; 418/55.1

(58) Field of Classification Search ..... 418/83, 418/101, 91, 92, 94, 55.1
See application file for complete search history.

(56) References Cited

U.S. PATENT DOCUMENTS

| | | | | |
|---|---|---|---|---|
| 4,958,991 | A | 9/1990 | Kikuchi | |
| 5,417,554 | A * | 5/1995 | Kietzman et al. | 418/101 |
| 5,616,015 | A | 4/1997 | Liepert | |
| 5,842,843 | A | 12/1998 | Haga | |
| 6,109,897 | A | 8/2000 | Haga | |
| 6,149,405 | A * | 11/2000 | Abe et al. | 418/94 |
| 6,186,755 | B1 | 2/2001 | Haga | |
| 6,190,145 | B1 * | 2/2001 | Fujioka et al. | 418/101 |
| 6,499,977 | B2 * | 12/2002 | Barito et al. | 418/55.1 |
| 6,503,069 | B2 | 1/2003 | Moroi et al. | |
| 6,905,320 | B2 | 6/2005 | Satoh et al. | |
| 6,953,330 | B1 | 10/2005 | Muto | |
| 7,121,816 | B2 * | 10/2006 | Matsushima | 418/101 |
| 7,121,817 | B2 | 10/2006 | Yanagisawa et al. | |
| 7,179,068 | B2 * | 2/2007 | Makino et al. | 418/101 |
| 7,309,219 | B2 | 12/2007 | Komai et al. | |
| 7,329,108 | B2 | 2/2008 | Tsuchiya et al. | |
| 7,387,503 | B2 | 6/2008 | Toda et al. | |
| 7,467,933 | B2 | 12/2008 | Ni | |
| 2006/0078452 | A1 | 4/2006 | Park et al. | |

OTHER PUBLICATIONS

International search report issued in corresponding application PCT/US2009/062522, dated May 3, 2010 (3 pages).
Written Opinion of the International Searching Authority issued in corresponding application PCT/US2009/062522, dated May 3, 2010 (3 pages).

* cited by examiner

*Primary Examiner* — Mary A Davis
(74) *Attorney, Agent, or Firm* — Hamre, Schumann, Mueller & Larson, P.C.

(57) ABSTRACT

An axial air cooling system for scroll-type positive fluid displacement apparatus provides needed cooling. The system includes an axial fan and centrifugal pump and internal cooling air channels inside parts integrating main housing, base housing and motor housing with their corresponding shell parts by cooling fins. The cooling air channel also includes passages inside the orbiting scroll, shaft central hole and gaps inside stator slots and winding. Heat pipes are installed inside the fixed and orbiting scrolls to conduct heat from inside of the apparatus to the peripheral condenser portion of the heat pipes to be cooled by the cooling air.

11 Claims, 12 Drawing Sheets

SCROLL-TYPE FLUID DISPLACEMENT APPARATUS WITH IMPROVED COOLING SYSTEM

FIELD

This disclosure relates to a scroll-type positive fluid displacement apparatus and more particularly to a scroll-type apparatus having an improved cooling system.

BACKGROUND

There is known in the art a class of devices generally referred to as "scroll" pumps, compressors and expanders, wherein two interfitting spiroidal or involute spiral elements are conjugate to each other and are mounted on separate end plates forming what may be termed as fixed and orbiting scrolls. These elements are interfitted to form line contacts between spiral elements.

A pair of adjacent line contacts and the surfaces of end plates form at least one sealed off pocket. When one scroll, i.e. the orbiting scroll, makes relative orbiting motion, i.e. circular translation, with respect to the other, the line contacts on the spiral walls move along the walls and thus change the volume of the sealed off pocket. The volume change of the pocket will expand or compress the fluid in the pocket, depending on the direction of the orbiting motion.

Gas compression generates heat. Particularly, when air and gases with high specific heat ratio $C_p/C_v$ are compressed, the heat generation is tremendous. In oil free compression, in order to achieve clean compressed gas, there is no oil, water or other lubricants and coolant allowed. However, the efficient removal of heat generated in the compression process is critical.

U.S. Pat. Nos. 5,842,843, 6,109,897 and 6,186,755 to Shuji Haga disclose a cooling means inside the drive shaft. The heat generated during compression can be removed at the central part of the compressor. The cooling means includes fans blowing cooling air directly towards the end plates of stationary scroll members. In some embodiments, the cooling means includes eccentrically installed heat pipes in the central portion of the drive shaft. In other embodiments, the cooling means includes an air passage in the central portion of the drive shaft to provide cooling air to enhance the cooling effects.

However, these designs have several shortcomings. First, the cooling fans directly blow cooling air to nearby endplates of stationary scroll members. The impinging flow to the endplate creates reverse flow and vortices that prevent cooling air from reaching the entire surface of the endplate needing cooling. Second, there are at most two heat pipes which can be installed in the central region of the drive shaft and the heat pipe condensers cannot be well cooled by cooling air because they are located inside the drive shaft that leads to low heat dissipation efficiency of the heat pipes. Third, the cooling air in the passage inside the drive shaft is driven by a centrifugal effect determined by the radial distance of the shaft OD which is fairly small. The cooling air is also driven by the low pressure upstream the fans that is also small. In other words, the cooling air flow inside the passage of the drive shaft is weak. Furthermore, the heat generated inside the scroll members is conducted to the shaft by overcoming a contact heat resistance between the scroll members and the shaft, and then is transferred by convection to the cooling air in the central hole of the drive shaft. This makes the heat dissipation from scroll members to the cooling air inefficient.

Referring to U.S. Pat. No. 6,905,320 B2 to Tohru Satoh, et al, an air cooling system provides transverse cooling air passing through the cooling fins on the opposite side of the scroll elements to cool the orbiting and fixed scroll. This cooling system needs an independent cooling fan to provide cooling air in the transverse direction and thus increases the cross sectional dimension. In addition, this cooling system does not provide cooling to the motor which usually need a separate cooling system.

U.S. Pat. No. 7,329,108 to Masaru Tsuchiya, et al. discloses a blowing fan between the orbiting scroll and the motor. This fan provides cooling air to the back of the fixed scroll, the crank handles and their bearings. However, the cooling fan system interrupts the motor shaft and the scroll driving shaft which will cause alignment difficulty. Furthermore, due to the zigzag of the cooling air passages, the cooling air experiences tremendous pressure loss that will seriously reduce the cooling air flow rate. Furthermore, there are air passages located downstream of the cooling fan. This arrangement of air passages creates significant pressure resistance to the fan and reduces the cooling air flow rates.

The prior art mentioned above does not provide sufficient cooling to the scrolls, bearings and motors. A more robust cooling system is necessary.

SUMMARY

A scroll-type fluid displacement apparatus is described with a compact axial cooling system to cool scrolls, bearings and the motor. In this cooling system, at least one axial cooling fan draws air from the front end of the compressor. The cooling air flows along the surface of the compressor parts via axial air channels and is blown out by the fan at the rear end of the compressor to maximize the air flow and forced convection heat transfer.

A heat pipe mechanism is also described. In this mechanism, multiple heat pipes are installed in the fixed and orbiting scroll members as well to maximize heat transfer from the inside bodies of parts to the condenser sides of the heat pipes. The condenser sides of the heat pipes are directly exposed to the cooling air flowing in the cooling air channels, to efficiently transfer heat from inside of the parts in the apparatus to the cooling air for maximum heat dissipation.

In addition, cooling air is provided by a centrifugal fan together with an axial fan via passages along radial air passages in the orbiting scroll end plate, the center axis of the driving shaft, and gaps between the motor stator and rotor, to lead cooling air into the inside and even the center, which are the hottest spots of the parts, to directly cool the orbiting scroll, the crank handle bearings, the orbiting scroll driving bearing, the main shaft bearings and the rotor and stator where cooling is essential.

A self-adjustable mechanism is also described to improve the performance and assembling of the orbiting dual thrust ball bearing mechanism.

DRAWINGS

Figure 9:
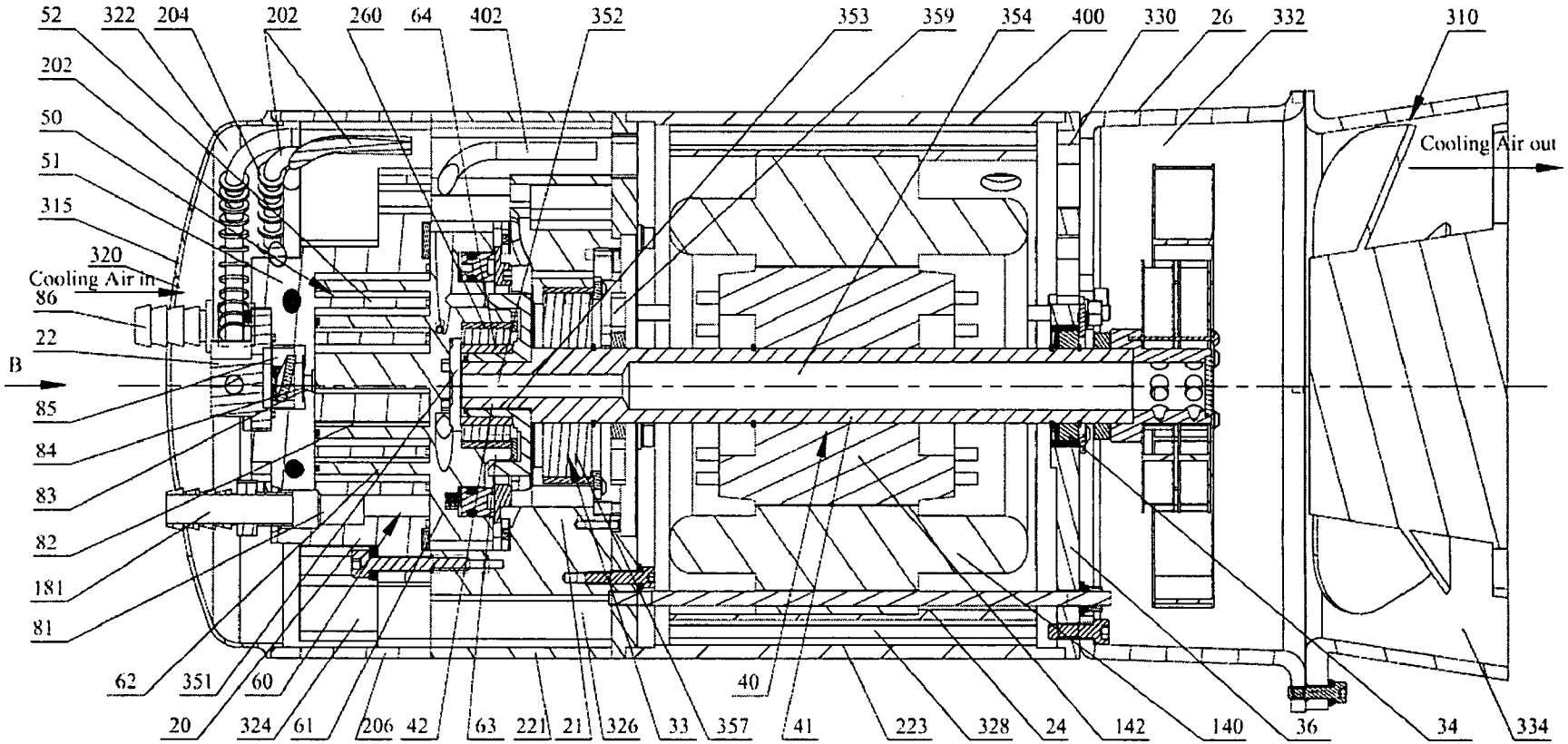
FIG. 9 is a cross-sectional view of an embodiment with the condenser sides of the fixed and orbiting heat pipes arranged parallel to the axis of air channels 1 and 2.
Figure 11:
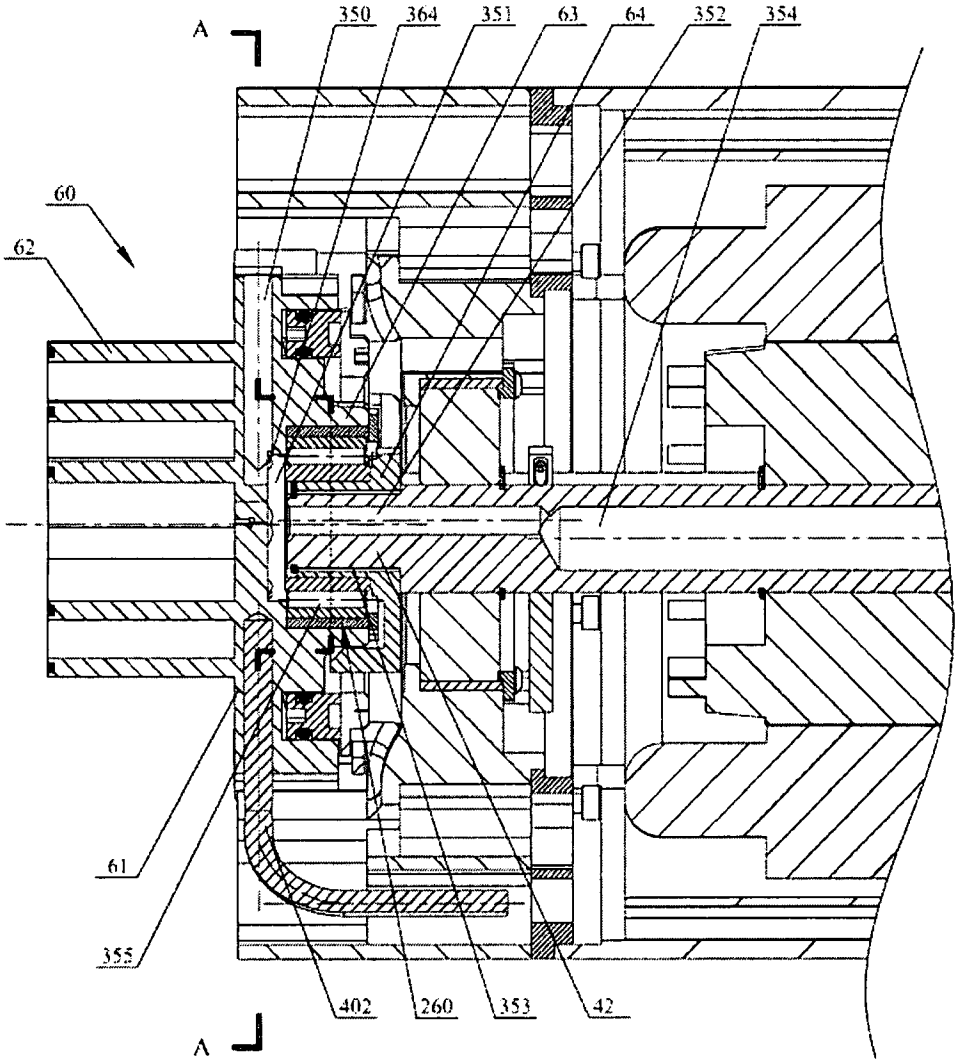

FIG. 11 is a cross-sectional view of the orbiting scroll 60 in FIG. 9 focusing on the orbiting scroll with orbiting heat pipes arranged parallel to the axis of air channels 1 and 2.

Figure 12:
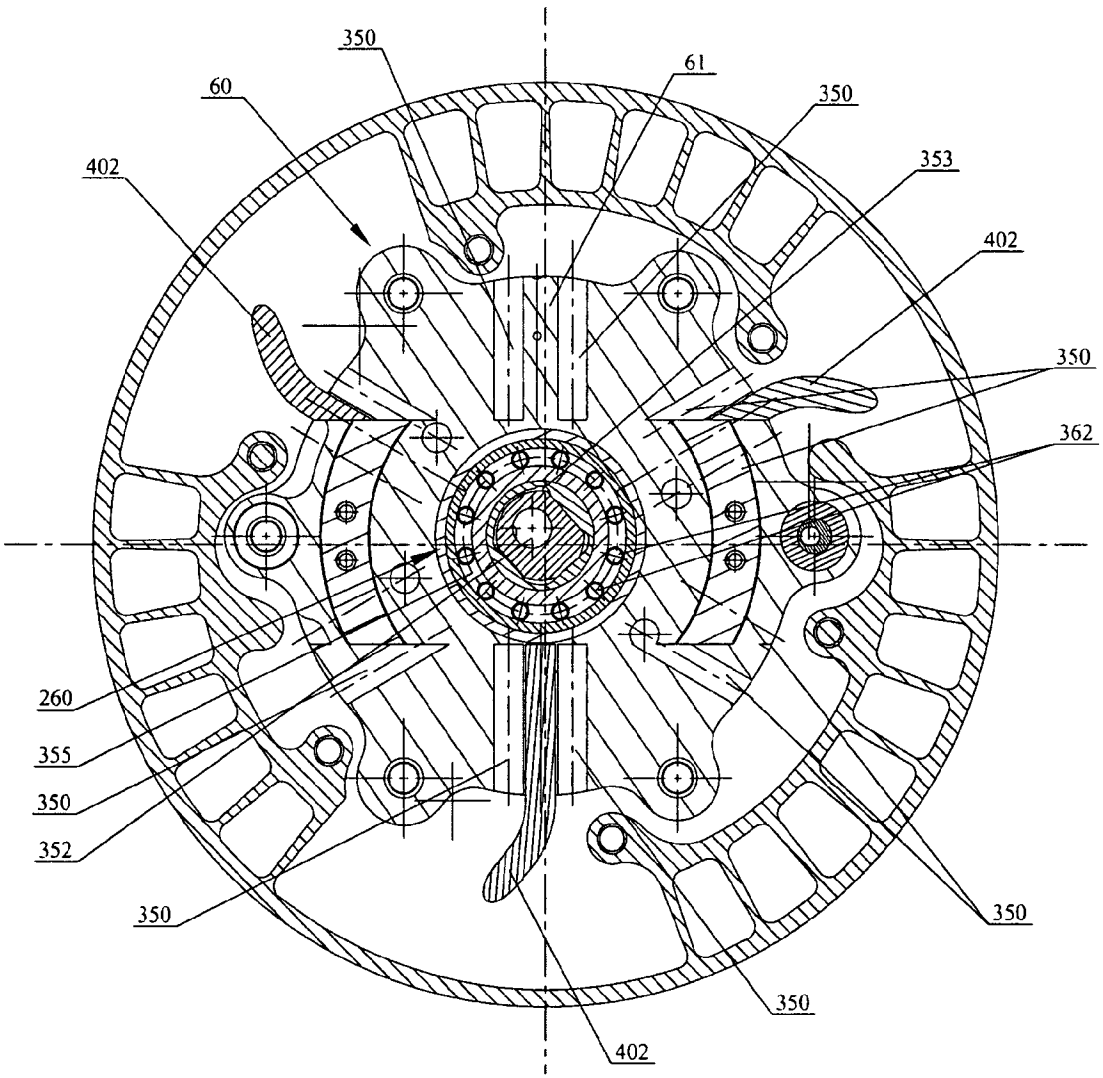

FIG. 12 is a cross-sectional view of the orbiting scroll with orbiting heat pipes arranged parallel to the axis of air channels 1 and 2 taken along line A-A of FIG. 11.

DETAILED DESCRIPTION

Figure 1:
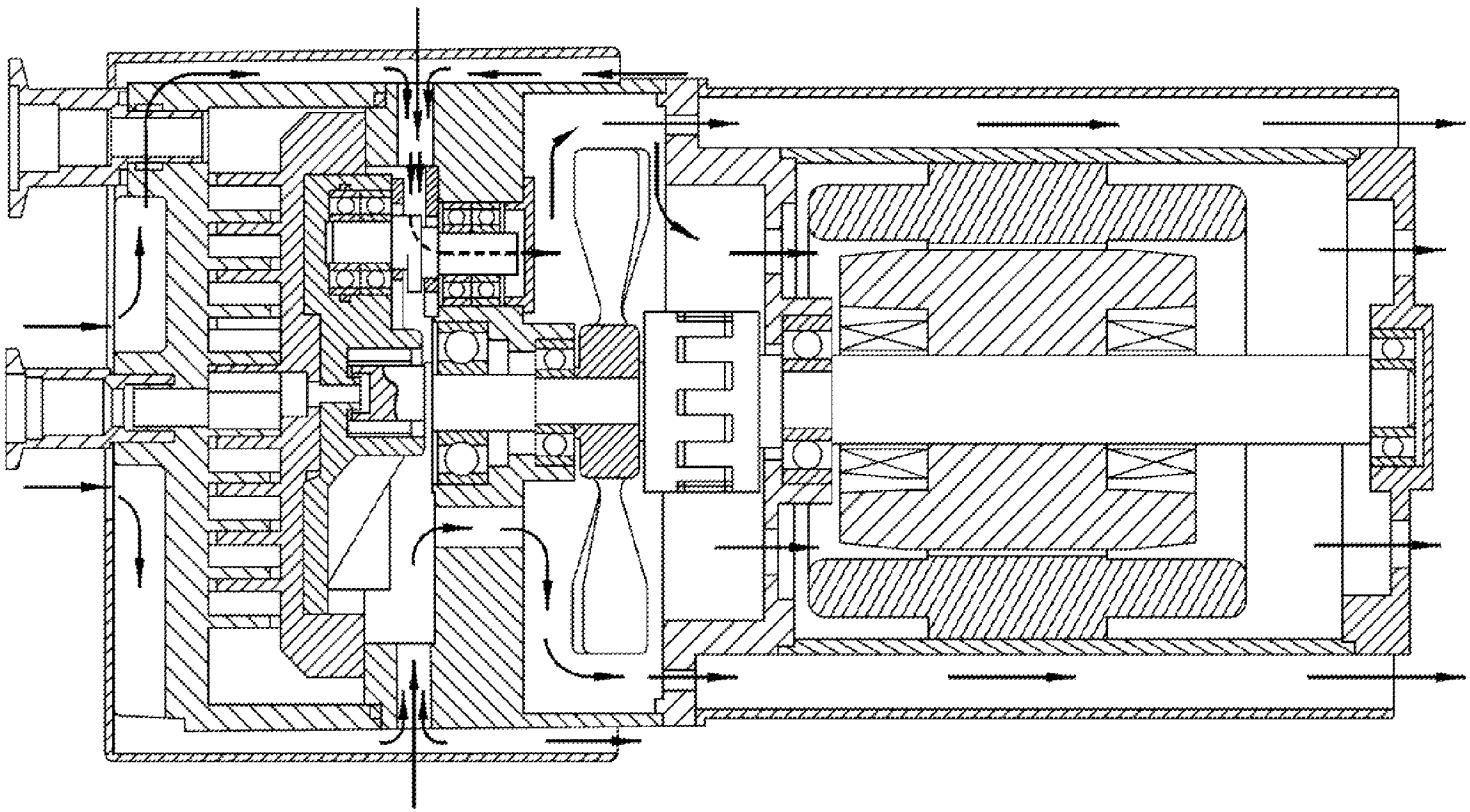
FIG. 1 (PRIOR ART)
FIG. 1 is a cross-sectional view of a prior art scroll-type positive fluid displacement apparatus with an axial cooling system.
Figure 2:
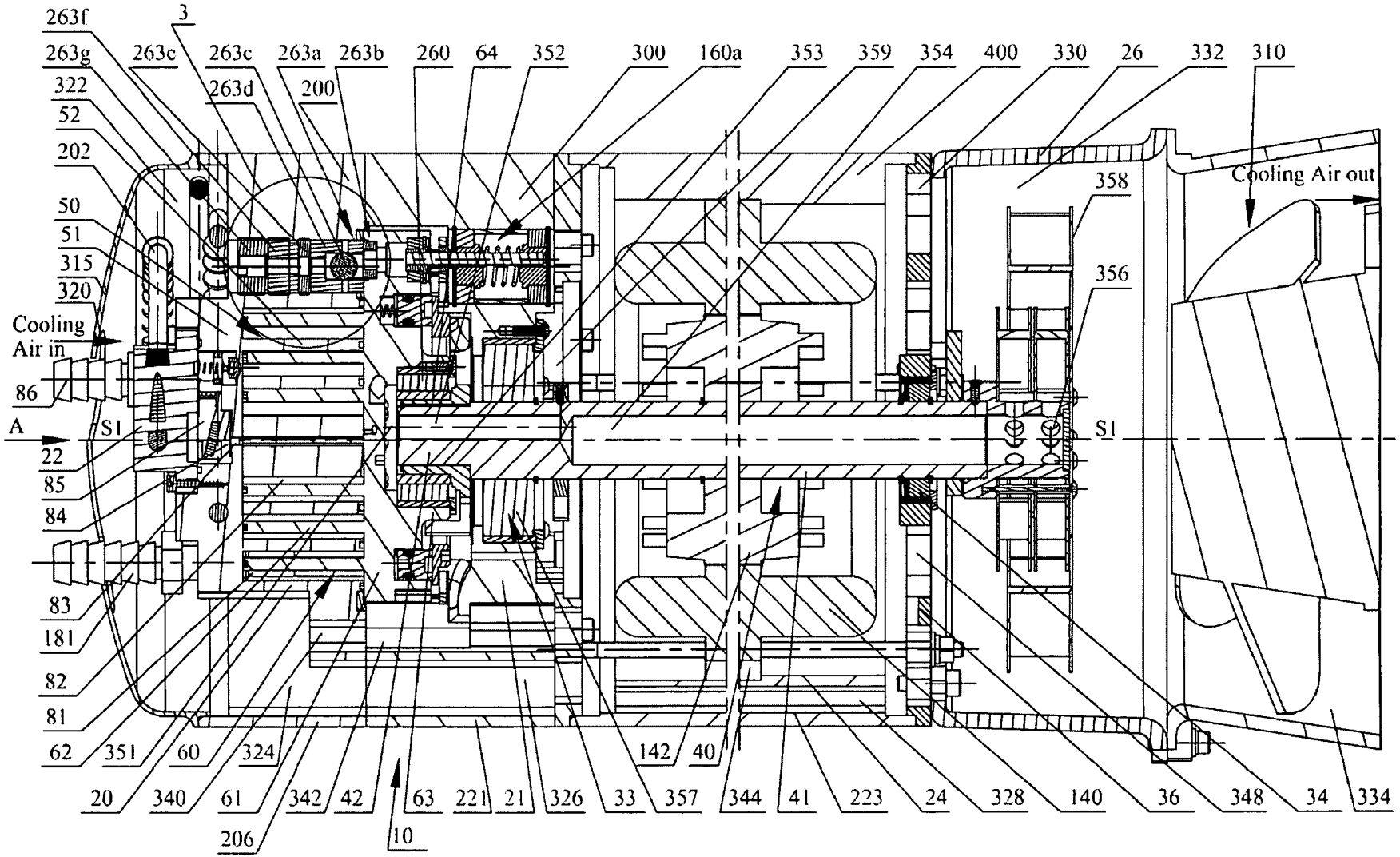
FIG. 2 is a cross-sectional view of an embodiment of a fully compliant floating scroll compressor with an axial cooling system in accordance with the invention taken along line A-A in FIG. 4.
Figure 5:
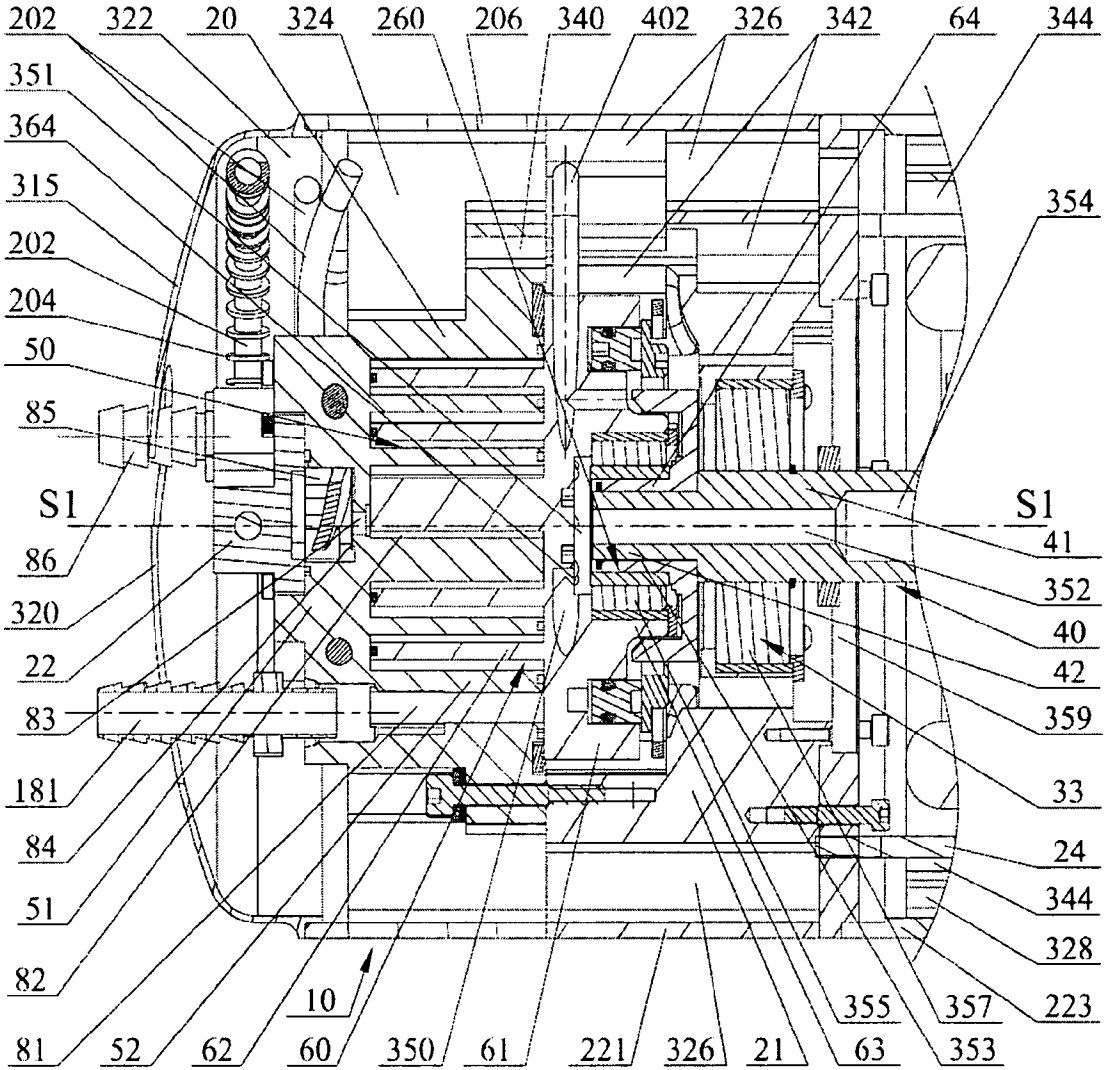
FIG. 5 is a cross-sectional view of the main housing 20 taken along line B-B of FIG. 4.

Referring to FIGS. 2 and 5, a fully compliant floating scroll air compressor with an axial cooling system is shown. Air compressor unit 10 includes a main housing 20, base housing 21, motor housing 24, rear bearing plate 36, crankshaft 40, fixed scroll 50 and orbiting scroll 60. The crankshaft 40 includes a central rod 41 and a crank pin 42. The central rod 41 is rotatably supported by bearings 33 and 34, and rotates about its axis S1-S1. The fixed scroll member 50 has an end plate 51 from which a scroll element 52 extends. The orbiting scroll member 60 includes a circular end plate 61, a scroll element 62 affixed to and extending from the end plate 61, and orbiting bearing hub 63 affixed to and extending from the central portion of the end plate 61. There is a crank pin bearing 260 inside the bearing hub 63. Scroll elements 52 and 62 are interfitted at an 180 degree angular offset, and at a radial offset having an orbiting radius Ror during operation. At least one sealed off fluid pocket is thereby defined between scroll elements 52 and 62, and end plates 51 and 61.

Referring to FIGS. 2, 3, 4, and 5, working fluid enters suction chamber 81 of compressor 10 from inlet port 181 and then is compressed through compression pockets formed between the scrolls during the orbiting motion of the orbiting scroll, and finally, reaches central pocket 82, discharges through discharge hole 83, reed valve 84, discharge plenum 85 and discharge port 86 at discharge cover 22. Sliding drive knuckle 64, crank pin bearing 260, crank pin 42 and peripheral swing link mechanism 160*a*, 160*b* and 160*c* (160*b* and 160*c* are the same as 160*a*, but not shown) work together as a so-called central drive shaft-sliding knuckle and peripheral crank pin-swing link mechanism or CSPS mechanism to perform the function of a redial semi-compliant mechanism that is disclosed in pending U.S. patent application Ser. No. 11/339,946, filed on Jan. 26, 2006.

Figure 3:
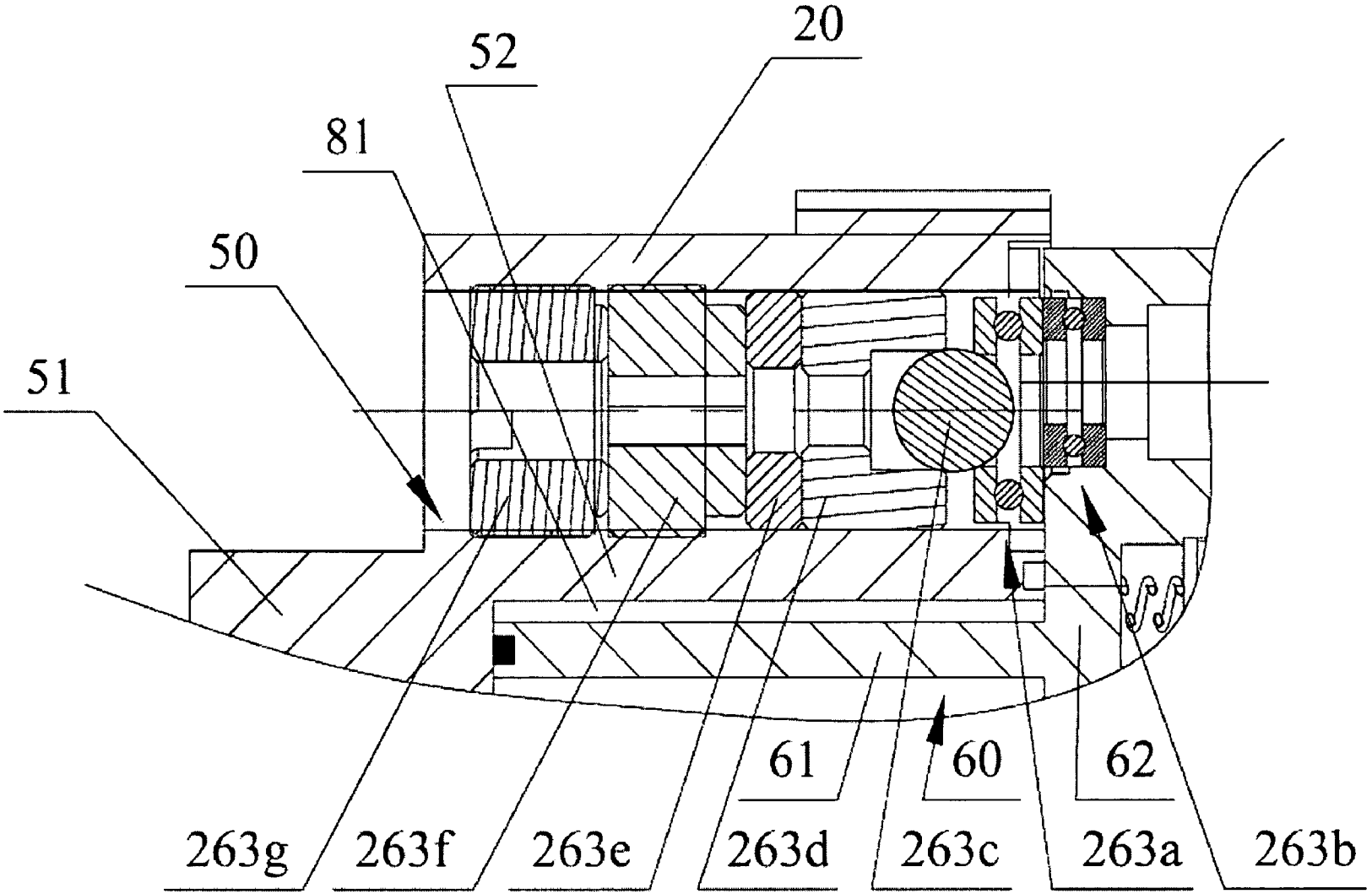
FIG. 3 is an enlarged view of the portion in bubble 3 of FIG. 2, illustrating the self-adjustable mechanism of the orbiting thrust bearing mechanism.

U.S. patent application Ser. No. 11/339,946 also discloses a multiple orbiting dual thrust ball bearing mechanism to counteract the axial thrust force and tipping moment of floating orbiting scroll during orbiting motion. In this mechanism there are multiple pairs, e.g. six pairs, of orbiting dual thrust ball bearings. Each pair of the orbiting dual thrust ball bearing mechanism works in the same way. For simplicity, only one of the six pairs of orbiting dual thrust ball bearings and the relevant parts are described in detail. The functions of the rest are similar and not separately described. The six pairs of orbiting dual thrust ball bearings must be assembled such that they evenly share the thrust load of the orbiting scroll at the same time keeping the orbiting scroll in contact with the fixed scroll at tips and corresponding base surfaces of the endplates and flank to flank of the scroll elements. Referring to FIGS. 2 and 3, the self-adjustable mechanism for the orbiting dual thrust ball bearing mechanism is described below.

A pair of the orbiting dual thrust ball bearing mechanism comprises a fixed thrust ball bearing 263*a* and an orbiting thrust ball bearing 263*b*. A self-adjustable mechanism includes orientation ball 263*c*, ball seat 263*d*, shim 263*e*, and two adjust nuts 263*f* and 263*g* with fine threads. The diameter of orientation ball 263*c* is so sized that fixed thrust ball bearing 263*a* can adjust its orientation to assure that the rotating washers of fixed and orbiting thrust ball bearings 263*a* and 263*b* have a good surface contact. Adjust nuts 263*f* and 263*g* together with shim 263*e* can fine tune the axial location of dual thrust ball bearings 263*a* and 263*b* to assure the proper axial engagement of the orbiting and fixed scrolls.

There are three air channels, channel 1, channel 2 and channel 3 in the cooling system of the illustrated embodiment to let cooling air pass through the cooling fins and parts to cool the compressors.

Figure 4:
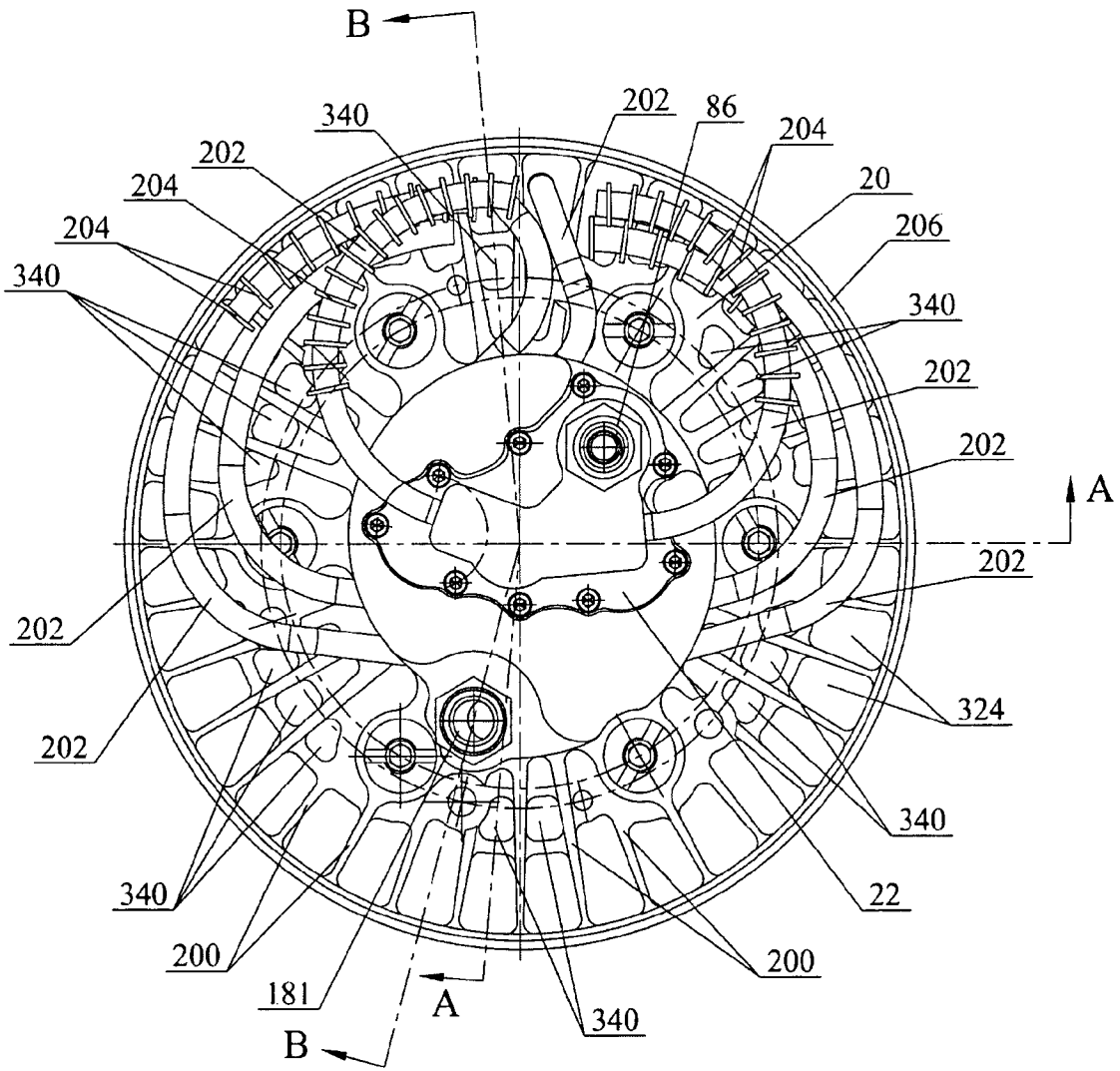
FIG. 4 is a view looking in the direction A from the left of the main housing 20 as shown in FIG. 2 when the guide cover 315 is removed.

Referring to FIGS. 2, 4, and 5, the first air channel, channel 1, of cooling air comprises inlet opening 320 of guide cover 315, air passage 322 between cover 315 and main housing 20, air passage 324 between main housing 20 and main housing shell 206, air passage 326 between base housing 21 and base shell 221, air passage 328 between motor housing 24 and motor shell 223, air passage 330 on rear bearing plate 36, air passage 332 of fan housing 26 and outlet 334. Fan 310 draws in cooling air from front inlet opening 320. The cooling air passes though channel 1 then is blown out through outlet 334 to ambient by fan 310.

Channel 1 is entirely internal in the compressor and is located in between compressor parts and cooling fins to enhance cooling effects. Passage 324 is an internal passage between main housing 20 and main housing shell 206 which are linked together by cooling fins 200 as one integrated part. Passage 326 is an internal passage of base housing 21 and base housing shell 221 which are linked by fins 300 as one integrated part. Passage 328 is an internal passage of motor housing 24 and motor housing shell 223 which are linked by fins 400 as one integrated part. This structure in which air passages, i.e. 324, 326 and 328, are internal in the above mentioned integrated parts with large fin areas and linked in unidirectional series, greatly reduces the pressure drop of the cooling air flow and therefore enhances the forced convection heat transfer by the cooling air. On the other hand, the heat generated by the compression process and motor in main housing 20, base housing 21 and motor housing 24 is conducted out by cooling fins 200, 300 and 400, respectively to be cooled by cooling air by convection heat transfer.

To enhance the conduction heat transfer, multiple fixed heat pipes 202 are installed inside the fixed scroll end plate 51 and main housing 20. These heat pipes are fixed to the respective parts and called fixed heat pipes.

Figure 6:
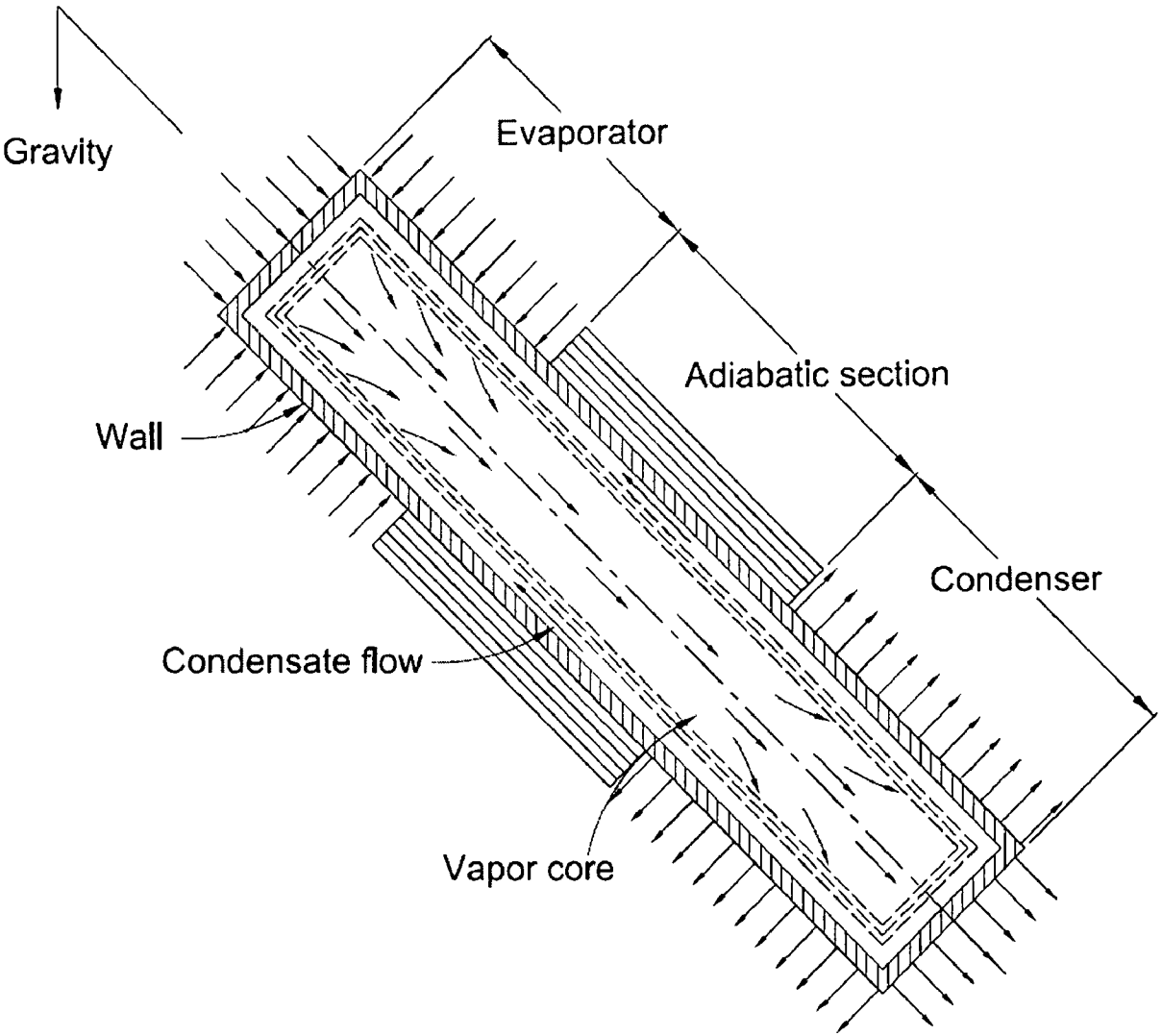
FIG. 6 is an amplified cross-sectional view of a heat pipe illustrating its working principle.

A heat pipe is a well known device for the transport of thermal energy. It is a closed structure as shown in FIG. 6, containing a working fluid, e.g. water, that transports thermal energy from one part, called the evaporator, where heat is supplied to the device, to another part, called the condenser, where heat is extracted from the device. The energy transport is accomplished by means of liquid vaporization in the evaporator, vapor flow in the core region, vapor condensation in the condenser, and condensate return to the evaporator by capillary action in the wick. The wick could be narrow grooves on the pipe wall or sintered powder metal on the inner wall of the heat pipe. Some heat pipes are gravity sensitive and others are not. The evaporator ends of the fixed heat pipes 202 are installed in the hot body of the fixed scroll end plate 51 and main housing 20, and the condenser ends are exposed to the cooling air flow in air passage 322 and/or 324 of channel 1. The condenser ends of heat pipes are equipped with cooling fins 204 to enhance heat dissipation from the heat pipes to the cooling air.

Figure 7:
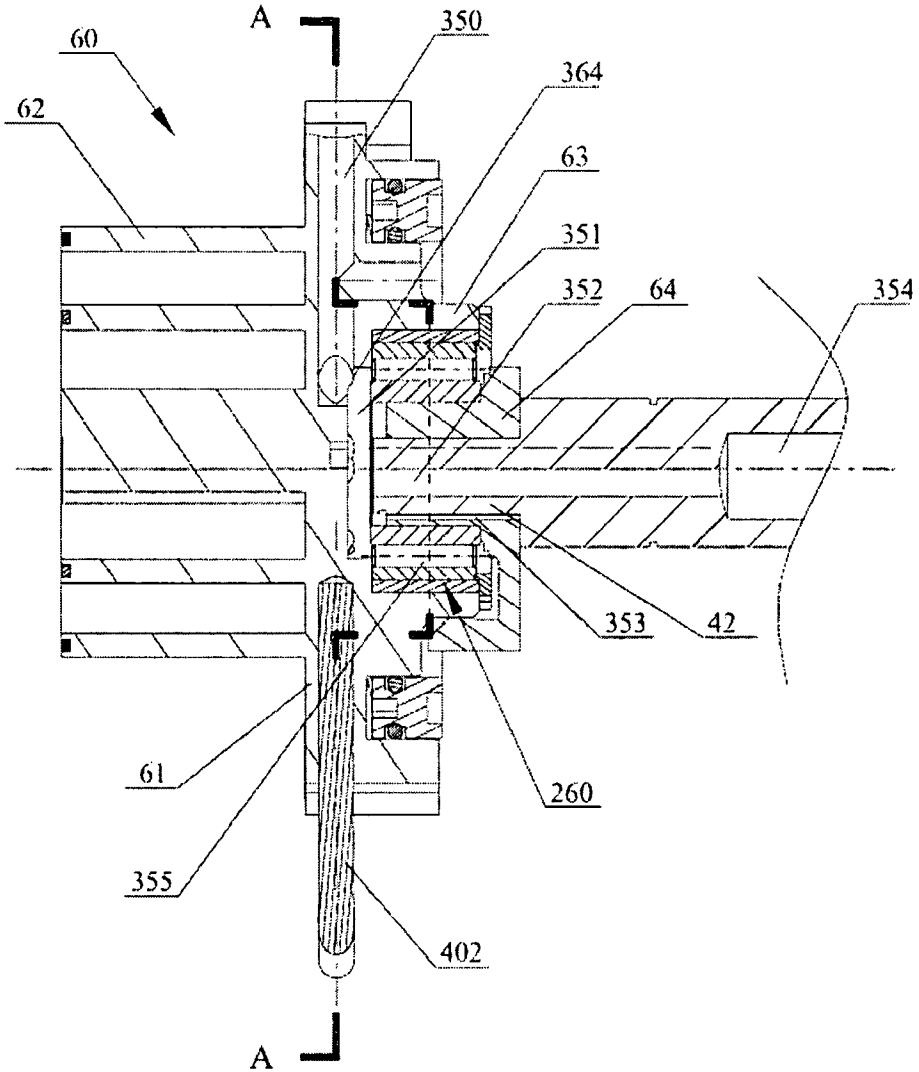
FIG. 7 is a cross-sectional view of the orbiting scroll 60 of FIG. 2 focusing on the orbiting scroll, orbiting heat pipes and driving mechanism to illustrate the details of a third cooling air channel.
Figure 8:
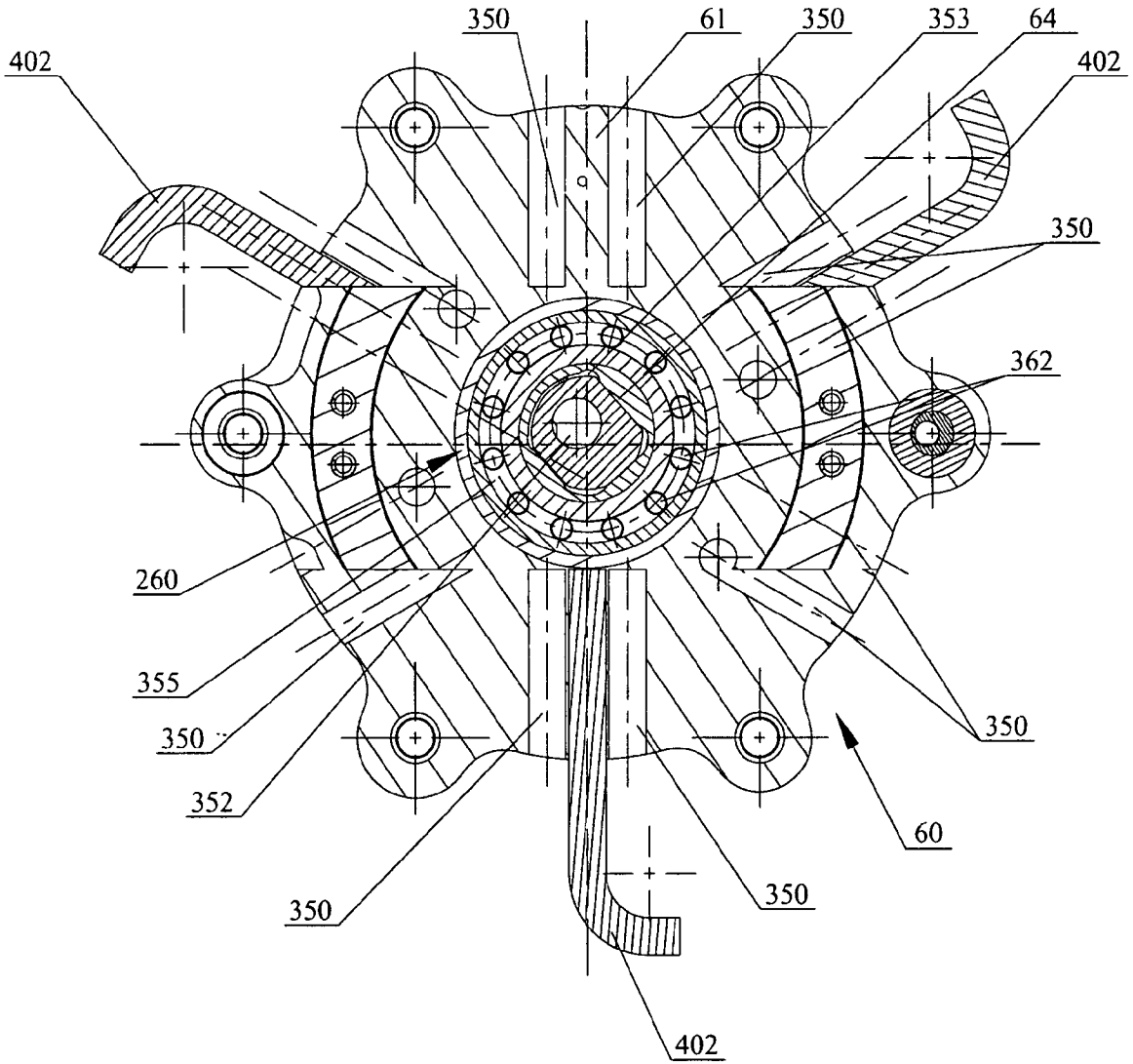
FIG. 8 is a cross-sectional view of orbiting scroll with orbiting heat pipes taken along line A-A of FIG. 7.

Referring to FIGS. 2 and 4, and 5, the second air channel, i.e. channel 2, of the cooling air is illustrated. Channel 2 is parallel to the channel 1 and comprises passage 340 in main housing 20, passage 342 in base housing 21, passage 344 between the motor housing 24 and stator 140 and gaps between the stator slots and winding, and gaps between stator 140 and rotor 142, and passage 348 on rear bearing plate 36. The cooling air enters inlet opening 320 of guide cover 315 and then flows through passages 340, 342, and then flows in parallel through passage 344 and gaps between the stator slots and winding, and gaps between stator 140 and rotor 142, then flows through passage 348 in rear motor bearing plate 36, finally sucked by fan 310 and blown out through outlet 334 to ambient. Referring to FIGS. 5, 7 and 8, there are orbiting heat pipes 402 installed radially inside orbiting end plate 61 with the evaporator ends fixed in orbiting end plate 61 and the condenser ends exposed to cooling air in air passage 326 of channel 1 and 342 of channel 2 to be cooled by flowing cooling air. The second air channel providing cooling to the back of orbiting scroll 60, to knuckle 64, crank pin bearing 260, to shaft main bearing 33 and to the inside of motor stator and rotor greatly improves the cooling effectiveness.

There is a third cooling air channel, i.e. channel 3. Referring to FIGS. 2, 5, 7 and 8, channel 3 comprises passages 350, i.e. twelve radial passages in orbiting scroll end plate 61, passage 364, i.e. twelve corresponding holes, and passage 351 in the central region of orbiting bearing hub 63, parallel passages 3A and 3B and ends to passage 310 of channel 1. Passage 3A comprises passages 352 and 354 in the central region of crank shaft 40, holes 356 near the end of shaft central rod 41 and passage in centrifugal pump 358. Passage 3B comprises passage 353 (FIG. 8), i.e. gaps between the shaft crank pin 42 and knuckle 64, passage 355 (FIGS. 8 and 9), i.e. gaps between needles 362 inside crank pin needle bearing 260, air passage 357, i.e. gaps inside bearing 33 and passage 359 (FIGS. 2 and 5), i.e. space in the central region between base housing 21 and motor housing 24. Passage 3B then connects to 344 of the second air channel, channel 2 and to 332 of the first air channel, channel 1.

In channel 3, cooling air from passage 342 of channel 2, flows into radial passages 350 and then to the central region 351 of orbiting bearing hub 63 through twelve corresponding holes 364 (only one shown on FIGS. 5 and 7) for directly cooling orbiting scroll end plate 61. The cooling air then flows through two branch passages 3A and 3B and finally reaches passage 332 of channel 1. All cooling air through channel 1, 2 and 3 together are pumped out by fan 310 through outlet 334 to the ambient.

In order to enhance dissipation of heat from the condenser sides of the heat pipes by the cooling air, an embodiment shown in FIGS. 9, 10, 11 and 12 arranges the heat pipe condensing sides parallel to the compressor axis in the cooling air channel 1 and 2.

Figure 10:
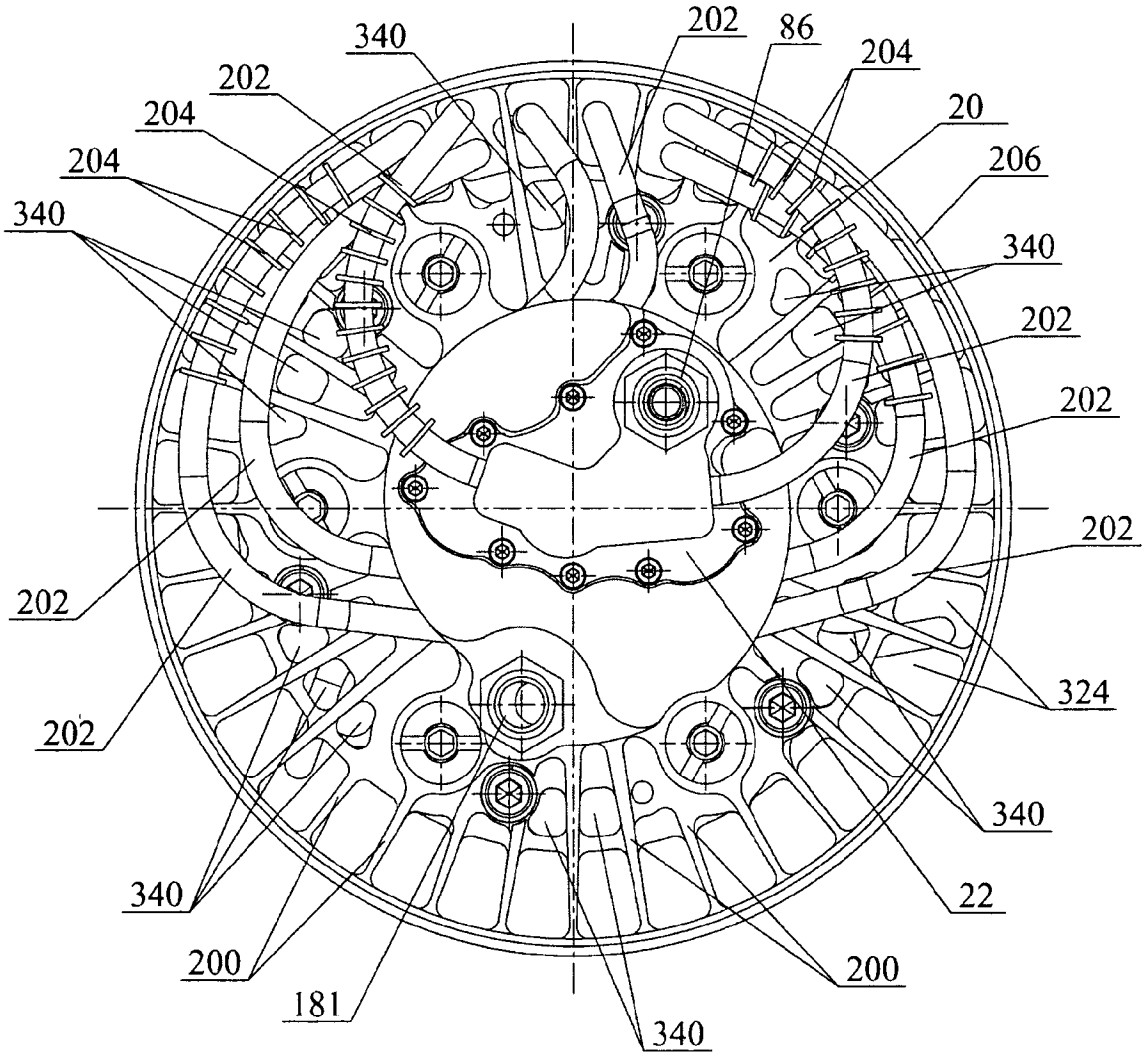
FIG. 10 is a view looking in the direction B from the left of the main housing 20 as shown in FIG. 9 when the guide cover 315 is removed.

FIG. 9 is basically the same as FIG. 2. The improvement is that the fixed heat pipes 202 and the orbiting heat pipes 402 are arranged such that their condensing sides wind up and then extend to the cooling air channel 1 and 2. This arrangement allows the heat pipe to take advantage of gravity and convection heat transfer by the cooling air. FIG. 10 illustrates the arrangement for the fixed heat pipes and FIGS. 11 and 12 illustrate the arrangement for the orbiting heat pipes.

While the above-described embodiments of the invention are preferred, those skilled in this art will recognize modifications of structure, arrangement, composition and the like which do not part from the true scope of the invention. The appended claims, and all devices define the invention and/or methods that come within the meaning of the claims, either literally or by equivalents, are intended to be embraced therein.

What is claimed is:

1. A positive fluid displacement apparatus, comprising:

a) an orbiting scroll member with a first end plate having a first involute wrap affixed to a base surface of said first end plate, an orbiting bearing hub affixed to the surface of said first end plate opposite to said first involute wrap and three generally equally-spaced peripheral portions on said first end plate;

b) a stationary scroll member with a second end plate having a second involute wrap affixed to a base surface of said second end plate of said stationary scroll member, said second involute wrap engaged with said first involute wrap of said orbiting scroll member, wherein when said orbiting scroll member orbits with respect to said stationary scroll member the flanks of said engaging wraps along with said base surface of said first end plate of said orbiting scroll member and said base surface of said second end plate of said stationary scroll member define moving pockets of variable volume and zones of high and low fluid pressures;

c) a rotatable drive shaft arranged to drive said orbiting scroll member to experience orbiting motion with respect to said stationary scroll member;

d) a main housing supporting said stationary scroll member;

e) a base housing supporting said drive shaft within a central portion of said base housing;

f) a motor housing supporting a motor stator;

g) said main housing is integrated with a main housing shell by first cooling fins, and first air passages are formed between said main housing shell, said main housing and said first cooling fins;

h) said base housing is integrated with a base housing shell by second cooling fins, and second air passages are formed between said base housing shell, said base housing and said second cooling fins;

i) said motor housing is integrated with a motor housing shell by third cooling fins, and third air passages are formed between said motor housing shell, said motor housing and said third cooling fins;

j) a first cooling air channel including said first air passages in said main housing shell linked in series with said second air passages in said base housing shell and said third air passages in said motor housing shell to form a unidirectional axial cooling air channel; and k) a cooling fan drawing cooling air through said first cooling air channel.

2. A positive fluid displacement apparatus in accordance with claim 1, wherein a second cooling air channel is provided parallel to said first cooling air channel, said second cooling air channel is located inside said main housing, said base housing and said motor housing, connects to said first cooling air channel, and directs cooling air from said first cooling air channel to the back of said orbiting scroll member and inside of said motor housing.

3. A positive fluid displacement apparatus in accordance with claim 2, further comprising a heat pipe with a condenser end thereof installed within the first or second cooling air channel parallel to the drive shaft.

4. A positive fluid displacement apparatus in accordance with claim 1, wherein an additional cooling air channel is provided having radial passages in said orbiting scroll member to direct cooling air to a central region of said orbiting bearing hub, and including axial passages in a central region through said drive shaft to direct cooling air from said radial passages to a centrifugal pump at an end of said drive shaft.

5. A positive fluid displacement apparatus in accordance with claim 1, further comprising:

a) an orbiting dual thrust ball bearing mechanism that includes a fixed thrust ball bearing and an orbiting thrust ball bearing;

b) said fixed thrust ball bearing having a first stationary washer fixed to a stationary part of said apparatus, a first rotating washer capable of rotating around its own axis, and first balls with a first cage located between said first stationary washer and said first rotating washer;

c) said orbiting dual thrust ball bearing mechanism having a second stationary washer fixed to said orbiting scroll member, a second rotating washer capable of rotating around its own axis, and second balls with a second cage located between said second stationary washer and said second rotating washer;

d) said first and second rotating washers having back-to-back contact and making sliding motion relative to each other;

e) said fixed and orbiting thrust ball bearings configured to bear thrust loads transferred from said second stationary washer to said second balls, then to said second rotating washer, then to said first rotating washer, and then to said first balls and finally to said first stationary washer, or vice versa;

f) an adjust ball supporting said first stationary washer and configured to maintain said first and second rotating washers in back-to-back contact;

g) a threaded nut in said stationary scroll member configured to adjust an axial position of said orbiting dual thrust ball bearing mechanism to maintain said stationary and orbiting scroll members in axial engagement.

6. A positive fluid displacement apparatus, comprising:

a) an orbiting scroll member with a first end plate having a first involute wrap affixed to a base surface of said first end plate, an orbiting bearing hub affixed to the surface of said first end plate opposite to said first involute wrap and three generally equally-spaced peripheral portions at said first end plate;

b) a stationary scroll member with a second end plate having a second involute wrap affixed to a base surface of said second end plate of said stationary scroll member, said second involute wrap engaged with said first involute wrap of said orbiting scroll member, wherein when said orbiting scroll member orbits with respect to said stationary scroll member the flanks of said engaging wraps along with said base surface of said first end plate of said orbiting scroll member and said base surface of said second end plate of said stationary scroll member define moving pockets of variable volume and zones of high and low fluid pressures;

c) a rotatable drive shaft arranged to drive said orbiting scroll member to experience orbiting motion with respect to said stationary scroll member;

d) a base housing supporting said drive shaft within a central portion of said base housing;

e) a motor housing supporting a motor stator;

f) a main housing supporting said stationary scroll member; and g) a first heat pipe installed with a first heat pipe evaporator end fixed inside said stationary scroll member in contact with the material forming the stationary scroll member to absorb heat from the stationary scroll member and a first heat pipe condenser end exposed to cooling air to transfer heat from said stationary scroll member to cooling air, the first heat pipe extends radially relative to the rotatable drive shaft and the first heat pipe condenser end is positioned radially outward from the first heat pipe evaporator end.

7. A positive fluid displacement apparatus in accordance with claim 6, further comprising a second heat pipe installed with a second heat pipe evaporator end fixed inside said orbiting scroll member and a second heat pipe condenser end thereof exposed to cooling air to transfer heat from said orbiting scroll member to cooling air, the second heat pipe extends radially relative to the rotatable drive shaft and the second heat pipe condenser end is positioned radially outward from the second heat pipe evaporator end.

8. A positive fluid displacement apparatus in accordance with claim 7, wherein the second heat pipe further includes a portion that extends axially relative to the rotatable drive shaft and the second heat pipe condenser end is axially displaced from the second heat pipe evaporator end.

9. A positive fluid displacement apparatus in accordance with claim 6, wherein the first heat pipe further includes a portion that extends axially relative to the rotatable drive shaft and the first heat pipe condenser end is axially displaced from the first heat pipe evaporator end.

10. A positive fluid displacement apparatus, comprising:

a) an orbiting scroll member with a first end plate having a first involute wrap affixed to a base surface of said first end plate, an orbiting bearing hub affixed to the surface of said first end plate opposite to said first involute wrap and three generally equally-spaced peripheral portions at said first end plate;

b) a stationary scroll member with a second end plate having a second involute wrap affixed to a base surface of said second end plate of said stationary scroll member, said second involute wrap engaged with said first involute wrap of said orbiting scroll member, wherein when said orbiting scroll member orbits with respect to said stationary scroll member the flanks of said engaging wraps along with said base surface of said first end plate of said orbiting scroll member and said base surface of said second end plate of said stationary scroll member define moving pockets of variable volume and zones of high and low fluid pressures;

c) a rotatable drive shaft arranged to drive said orbiting scroll member to experience orbiting motion with respect to said stationary scroll member;

d) a base housing supporting said drive shaft within a central portion of said base housing;

e) a motor housing supporting a motor stator;

f) a main housing supporting said stationary scroll member; and g) a first heat pipe installed with an evaporator end thereof fixed inside said orbiting scroll member in contact with the material forming the orbiting scroll member to absorb heat from the orbiting scroll member and a condenser end thereof exposed to cooling air to transfer heat from said orbiting scroll member to cooling air, the first heat pipe extends radially relative to the rotatable drive shaft and the condenser end is positioned radially outward from the evaporator end.

11. A positive fluid displacement apparatus in accordance with claim 10, wherein the first heat pipe further includes a portion that extends axially relative to the rotatable drive shaft and the condenser end is axially displaced from the evaporator end.

* * * * *